US008333140B2

(12) United States Patent
Meitzler et al.

(10) Patent No.: US 8,333,140 B2
(45) Date of Patent: Dec. 18, 2012

(54) SELF DIAGNOSTIC ARMOR STRUCTURE

(75) Inventors: Thomas J. Meitzler, Troy, MI (US); Jason A. Schrader, Warren, MI (US); Thomas P. Reynolds, Warren, MI (US); Samuel E. Ebenstein, Southfield, MI (US); Gregory H. Smith, Ann Arbor, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 131 days.

(21) Appl. No.: 13/039,878

(22) Filed: Mar. 3, 2011

(65) Prior Publication Data

US 2012/0222543 A1 Sep. 6, 2012

(51) Int. Cl.
*F41H 5/02* (2006.01)

(52) U.S. Cl. ..... 89/36.02; 89/36.08; 89/904; 89/930; 109/21

(58) Field of Classification Search ..... 89/36.02, 89/36.07, 36.08, 36.09, 930, 904; 109/21; 356/239.1, 239.3
See application file for complete search history.

(56) References Cited

U.S. PATENT DOCUMENTS

| | | | | |
|---|---|---|---|---|
| 2,375,260 | A | 5/1945 | Suydam | |
| 3,328,000 | A | 6/1967 | Rottmann | |
| 3,825,917 | A * | 7/1974 | Lucky | 340/550 |
| 4,399,357 | A | 8/1983 | Dorf et al. | |
| 4,483,615 | A | 11/1984 | Bieringer et al. | |
| 4,584,469 | A | 4/1986 | Lovalenti | |
| 5,002,820 | A | 3/1991 | Bolton et al. | |
| 5,020,908 | A | 6/1991 | Hermann | |
| 5,824,941 | A | 10/1998 | Knapper | |
| 6,211,952 | B1 | 4/2001 | Weiland et al. | |
| 6,532,857 | B1 | 3/2003 | Shih et al. | |

OTHER PUBLICATIONS

Tutorial, Image Analysis and Processing, Published May 15, 2008, National Instruments.
Image Gradient, Wikipedia.

* cited by examiner

*Primary Examiner* — Daniel Troy
(74) *Attorney, Agent, or Firm* — David L. Kuhn; Thomas W. Saur; Luis Miguel Acosta

(57) ABSTRACT

A unit of modular armor. The module has a box-like, optically opaque outer shell of ballistic-protection material enclosed to exclude light from the module's interior. The shell contains transparent armor plates and the shell contains a self-diagnostic system for ascertaining whether the plates have been damaged. The self-diagnostic system includes a first PC board disposed along first edges of the plates, the board being divided into strips on which are mounted rows of lights. The self-diagnostic system further includes a second PC board at second, opposed edges of the plates divided into strips on which are mounted rows of light receptors. The PC boards incorporate circuitry for illuminating the rows of the lights in a row-by-row sequence, and for allowing activation only of the receptors directly opposed to illuminated lights. This circuitry has an analysis means for determining the health of the plates in response to signals from the receptors. The armor module has a transparent, elastomeric, adhesive matrix within the shell in which each of the plates and boards are suspended and encapsulated, wherein the matrix occupies all space not occupied by other elements within the shell.

15 Claims, 3 Drawing Sheets

SELF DIAGNOSTIC ARMOR STRUCTURE

GOVERNMENT INTEREST

The invention described here may be made, used and licensed by and for the U.S. Government for governmental purposes without paying royalty to us.

BACKGROUND OF THE INVENTION

1. Field of the Invention

Generally, the present invention provides an improved structure for a box-like module of armor for military vehicles and particularly military vehicles engaged in combat operations. The invention also relates to the field of composite armor wherein layers of various materials including ceramics, metals, glass and polycarbonates are combined to create desired kinds and levels of ballistic protection. Finally the invention relates to the technology by which transparent objects of manufacture, such as bottles or glass plates are inspected for flaws.

2. Background Art

It is well known to create a layered transparent structure that provides protection from bullets or projectiles. Numerous references could be cited showing such structures, and an example is U.S. Pat. No. 5,002,820 to Bolton et al, which shows laminated safety glass which affords ballistic protection. Additionally, U.S. Pat. No. 5,824,941 to Knapper shows glass layers used with metal layers in a box-like armor structure. U.S. Pat. No. 6,532,857 B1 to Shih et al. shows an armor face component comprised of ceramic tiles in a planar array along a metal plate wherein the tiles and plate are encased in rubber. U.S. Pat. No. 2,375,260 to Suydam shows an apparatus for testing a block of transparent crystal by focusing a beam of light through one edge of the crystal, whereby light travels through the crystal and forms an image used to detect flaws therein. A basic tutorial on image processing, including analysis of light intensity variation in an image, is provided by a National Instruments publication entitled "Image Analysis and Processing," which can be found at http://zone.ni.com/devzone/cda/tut/p/id/3470.

SUMMARY OF THE INVENTION

The invention is a unit of modular armor for a vehicle which can be removed from the vehicle and replaced when the module is damaged by enemy fire. The exterior of the module has a box-like, optically opaque outer shell of ballistic-protection material such as armor steel. The shell is enclosed to exclude light from the module's interior. The module's interior contains transparent armor plates of variable material and thickness arranged in parallel, closely spaced relation. The module contains a self-diagnostic system for ascertaining whether the plates have been damaged as by cracking so that the module need not be opened or removed from the vehicle to determine its health. The self-diagnostic system includes a first PC board or circuit board disposed along first edges of the plates, the board being divided into strips on which are mounted rows of lights. The self-diagnostic system further includes a second PC or circuit board at second, opposed edges of the plates, the board divided into strips on which are mounted rows of light receptors. The PC boards incorporate circuitry for illuminating the rows of the lights in a row-by-row sequence, and for allowing activation only of the receptors directly opposed to illuminated lights. This circuitry has an analysis means for determining the health of the plates in response to signals from the receptors. The armor module has a transparent, resilient, shock absorbing matrix within the shell in which each of the plates and boards are suspended and encapsulated, wherein the matrix occupies all space not occupied by other elements within the shell.

DETAILED DESCRIPTION OF THE PREFERRED EMBODIMENT(S)

Definitions and Terminology:

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, dimension, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

Figure 1:
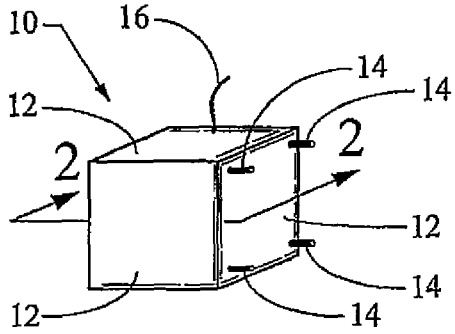
FIG. 1 is a perspective view of the exterior of the armor structure.

Referring to FIG. 1, there is shown the exterior of armor module 10 having the general shape of a cube having a length width and height in one embodiment of about fourteen inches. It is not necessary that armor module 10 be cubical in shape and may have any rectangular shape wherein the length width and height are not all equal. The faces 12 of module 10 are typically made of opaque sheets of ballistic protection material which inhibits the passage of X-rays therethrough. The sheets normally are plates of armor steel but can be made of armor grade aluminum or other suitable metal, depending upon the particular application for module 10. Faces 12 are typically 3 mm thick but the thickness can be varied as needed. The faces 12 form a completely enclosed box-like shell such that light outside module 10 does not enter it. Module 10 is provided with a means to attach it to a vehicle (vehicle not shown) which can be threaded studs 14 extending from one of faces 12. It will be understood that other attachment mechanisms could be used, such as brackets, weld connections or other known fastening and attachment mechanisms. Module 10 is provided with one or more bus leads as shown at 16 in FIG. 1. Lead 16 allows signals to be transmitted to and from elements within module 10 and allows electrical power to be transmitted to these elements.

Figure 2:
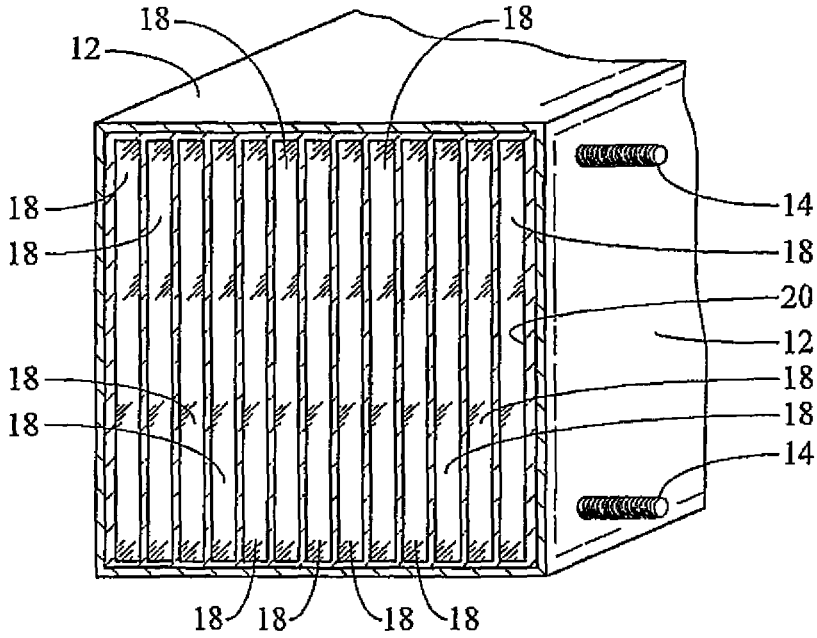
FIG. 2 is an enlarged, partial perspective view of the armor structure of FIG. 1 having one side removed in order to show certain interior components of the structure.

FIG. 2 shows armor module 10 with one face removed in order to illustrate some of its internal structural components. Within the module and oriented parallel to a pair of opposed faces 12 are transparent armor plates 18 which can be formed of any known transparent armor material and typically can be formed of glass, acrylics or polycarbonates. Normally, varied thicknesses and materials will be used for individual plates 18. The plates are completely surrounded by and embedded in a transparent matrix 20 such that the plates do not contact one another and do not contact the interior surfaces of faces 12. As better seen in FIG. 3, the regions 21 of matrix 20 adjacent faces 12 can be thicker than the faces themselves. The matrix entirely covers the interior surfaces of faces 12 and fills the spaces between plates 18 so that the plates and matrix form a solid, voidless body that completely fills the interior of module 10. As a consequence, armor module 10 as a whole is a solid, voidless body having an opaque exterior and a transparent interior. Matrix 20 is preferably formed of an elastomeric gel which is formed by a mixture of two liquids which hardens after being poured into module 10. Matrix 20 need not have the same thickness between any two plates 18 and the thickness of a planar region of the matrix material disposed on the interior surface of a given face 12 can vary from face to face. Preferably the plates are closely spaced so that the parts of matrix 20 between plates will most often be a relatively thin, sheet-like layer. Matrix 20 may be comprised of different materials at different zones thereof so that the ballistic characteristics or other characteristics of the matrix vary from one location between a first set of adjacent plates 18 and another location between a second set of adjacent plates. Likewise the material of matrix 10 in a planar region on the interior surface of one face 12 can vary from the material of a planar region of the matrix on another face. In any case, it is preferred that the material of matrix 20 have an adhesive quality so that matrix 20 bonds to plates 18, faces 12 and other elements embedded therein.

Figure 3:
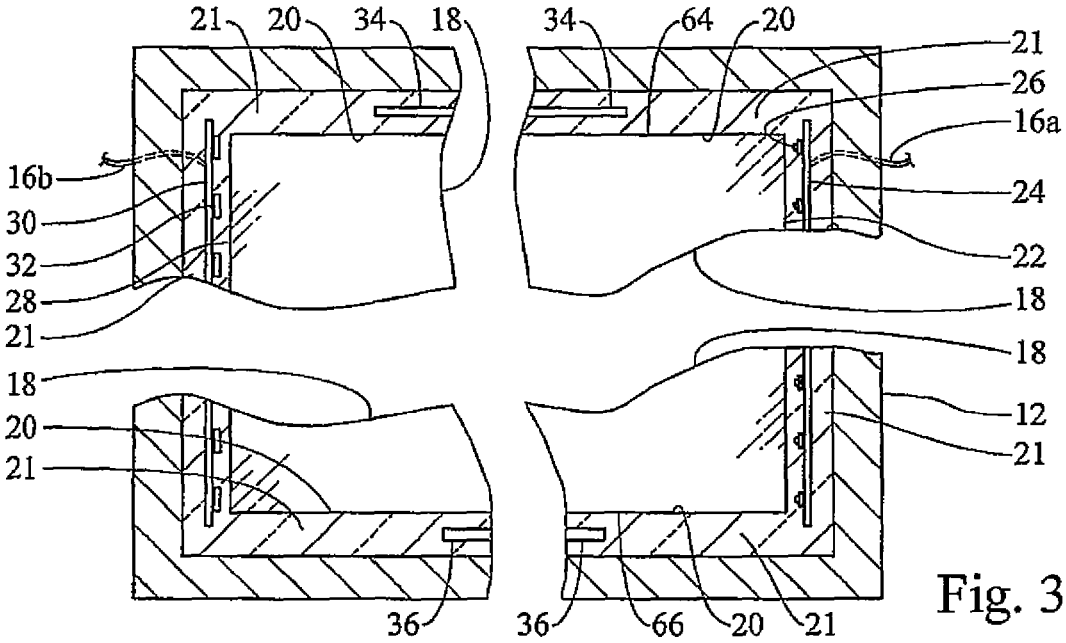
FIG. 3 is a partial sectional view of the armor structure of FIG. 1 showing additional components not show in FIG. 1 or FIG. 2.

FIG. 3 shows a partial sectional view of armor module 10 that is taken along a line of sight orthogonal to plates 18, the scale of FIG. 3 being enlarged to illustrate elements of the modular armor's self diagnostic system not shown in FIGS. 1 and 2. The self-diagnostic system is comprised of rows of lights, rows of light receptors, PC boards having strips or strip shaped zones for mounting the lights and receptors, and bus leads connected to the boards. Accordingly, embedded within matrix 20 and disposed adjacently along one edge 22 of plate 18 is light strip 24 having a row of lighted electric diodes (LEDs) or other miniature lights 26 mounted thereon. Typically lights 26 are commercially available LEDs having a dome shaped light emitting portion whose dome radius is 1 mm, whereby lights 26 can be regarded as point sources or essentially point sources of non collimated, incoherent light whose sectors or zones of illumination overlap. Illumination from lights 26 preferably have a wavelength of 600 nm since most materials used for plates 18 are transparent to illumination of this wavelength. Strip 24 is connected to bus lead 16*a*, which is part of CAN bus 34 shown in FIGS. 4 and 5. The lights are shown as slightly spaced from edge 22 with the spacing distance being 1 mm or less and it is possible to have lights 26 in contact with edge 22. The elastomeric character of the matrix serves as a protection in that it prevents or inhibits vibrations or jolts transferred to module 10 from affecting light strip 24, lights 26 and even plates 18. Also embedded within matrix 20 and adjacently disposed along another, opposing edge 28 of the plate is a receptor strip 30 having a row of miniature light receptors 32 in the form of solid state light detectors, photo diodes, photo voltaic units, photo transistors or other known type of photo detectors. The elastomeric character of the matrix here again prevents or inhibits vibrations or jolts transferred to module 10 from affecting strip 30, receptors 32 and plates 18. Strip 30 is connected to bus lead 16*b*, which is part of CAN bus 34 shown in FIGS. 4 and 5. As with the lights, receptors 32 are shown as slightly spaced from edge 28 with the spacing distance being 1 mm or less and it is possible to have receptors 32 in contact with edge 28. Preferably, each light 26 is directly across from a receptor 32 so that a line orthogonal to edges 22 and 28 intersecting a light 26 will also intersect a corresponding receptor 32. It will be understood that each plate 18 will have a light strip 24, lights 26, a receptor strip 30 and receptors 32 in the same manner as shown in FIG. 3. Strips 24 and 30 have circuitry connected respectively to bus leads 16*a* and 16*b* so that signals and power can be transmitted between electronic components external to module 10 and electronic components internal to module 10, such as lights 26 and receptors 32.

Figure 4:
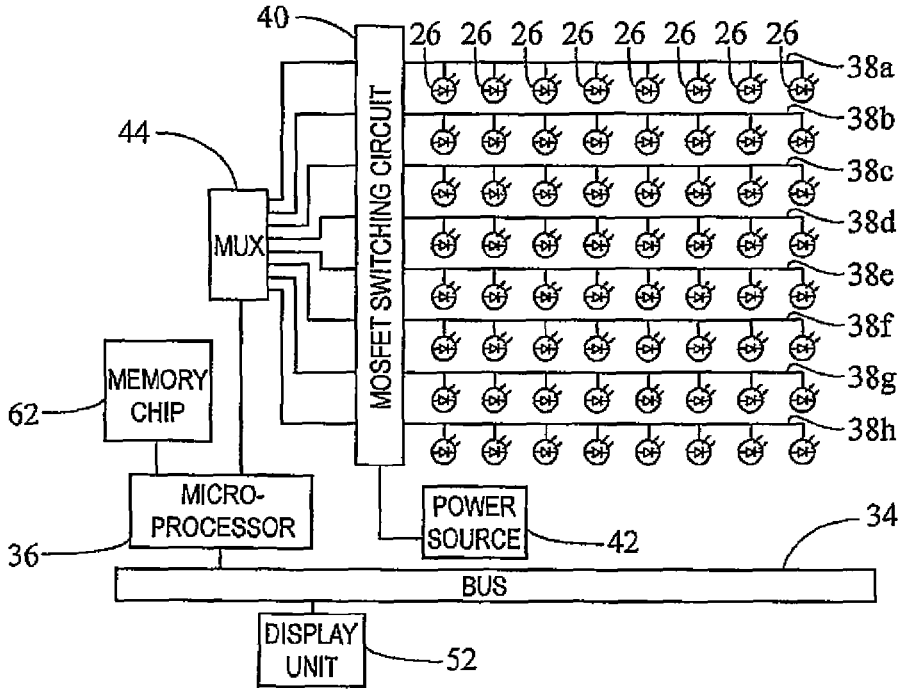
FIG. 4 shows the electronic circuitry associated with the operation of LEDs within the armor structure.
Figure 5:
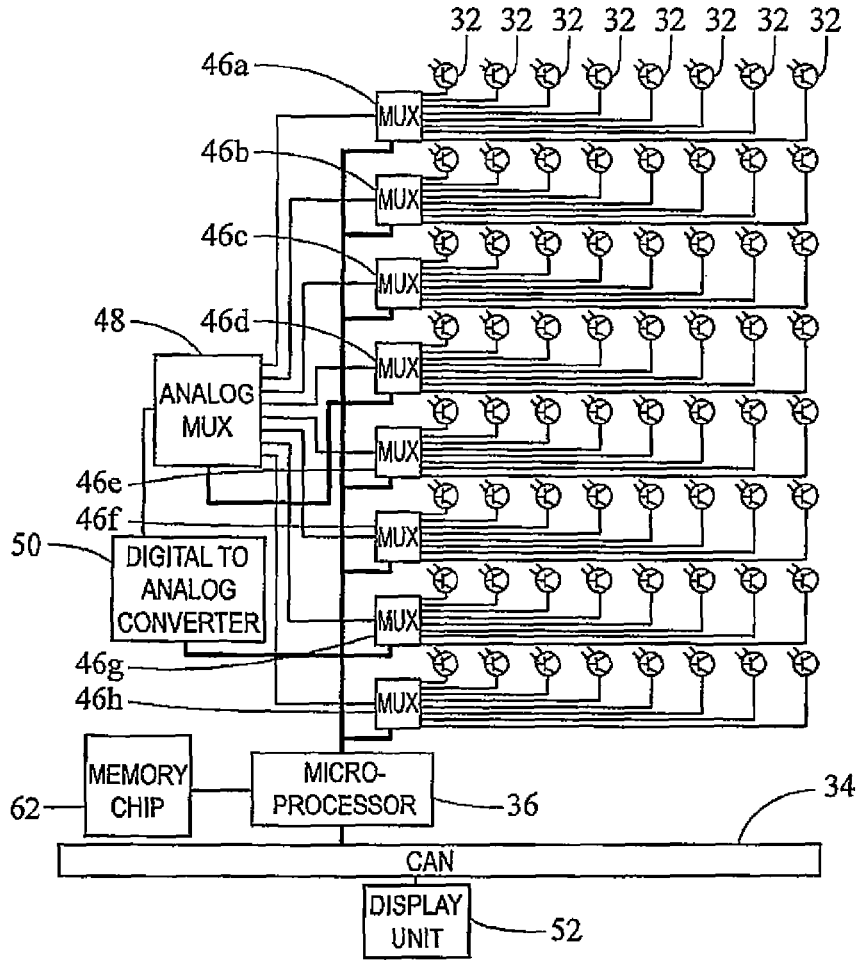
FIG. 5 shows the electronic circuitry associated with operation of photo sensors within the armor structure.

FIGS. 4 and 5 show schematically the electronic circuitry which operates lights 26 and receptors 32. The vehicle on which armor module 10 is installed has a controller area network bus or CAN bus 34 by which signals and power are supplied to microprocessor 36. CAN bus 34 and microprocessor 36 may be disposed in matrix 20 as shown in FIG. 3 or may be incorporated in the structure of a PC board comprised of strips 34 or a PC board comprised of strips 30. Circuitry elements associated with the lights are shown only in FIG. 4 and circuitry components associated with the receptors are shown only in FIG. 5. However it will be understood that both sets of circuitry elements are part of a single circuit of which microprocessor 36 and CAN bus 34 are part. In FIG. 4 several lines 38*a* through 38*h* are shown, and each of these lines communicates with a plurality of lights 26, though for convenience the lights only on line 38*a* are given reference numerals. Each line will be associated with and may be embedded in one of strips 24 (shown in FIG. 3) so that each plate 18 is paired with a line and associated lights 24. Lines 38*a* through 38*h* are connected to a switching circuit such as MOSFET driver 40 which controls voltage from LED driver voltage source 42 to the lines. Switching by MOSFET driver 40 is in turn governed by multiplexer 44, which responds to control signals from microprocessor 36. In operation the control signals from microprocessor 36 cause lights 24 on line 38*a* to illuminate and then be turned off, and these control signals next cause lights 24 on line 38*b* to illuminate and then be turned off, and so on until lights on line 36*h* illuminate and turn off.

FIG. 5 shows several multiplexers 46*a*-46*h* each communicated to a plurality of light receptors 32, though only the receptors associated with multiplexer 46*a* are given reference numerals. Each of these multiplexers communicates with or may be imbedded in one of strips 30 (FIG. 3) so that each plate 18 has a corresponding multiplexer and associated set of receptors 32. Multiplexers 46*a*-46*h* receive signals one receptor at a time from their respective sets of receptors 32, these signals representing measurements of light intensity experienced by individual receptors in each set. In response to the receptors' signals, corresponding signals are sent by multiplexers 46*a*-46*h* through analog multiplexer 48 to analog-to-digital converter 50 and then to microprocessor 36. Microprocessor 36 controls multiplexors 46*a*-46*h* so that multiplexer 46*a* allows signals from its receptors 32 only when lights 26 on line 38*a* illuminate. Multiplexers 46*b* through 46*h* are controlled similarly for their respective receptors and lights. Microprocessor 36 functions so that each plate 18 is illuminated for testing one at a time and in sequence, and only light receptors for the plate being tested will send signals to the microprocessor. Microprocessor 36 has a nonvolatile memory chip such as a compact flash whereby the microprocessor analyzes the signals from converter 50 to determine the state of health of plates 18. Additionally, microprocessor 36 transmits indicator signals representing the plates' health to a display unit 52, which can be of any conventional design. For example, unit 52 can be a display screen which shows numerical values for each plate 18 and can include a set of lights for each plate wherein a light of a given color represents a corresponding condition of the plate.

Preferably but not necessarily, strips 24 are not all separate components from each other but are formed from a single PC board wherein the strips are strip-shaped zones of the PC board disposed adjacent a given row of lights 26. The thickness of strips 24 or the PC board is about 1 mm and the board's length and width are approximately equal to the length and width of the inner surface of a face 12 at which the board is located. Likewise strips 30 are normally and preferably not all separate components from each other but are formed from another single PC board wherein the strips are strip-shaped zones of the PC board disposed adjacent a given row of receptors 32. The thickness of strips 30 or the board is about 1 mm and the board's length and width are approximately equal to the length and width of the inner surface of a face 12 at which the board is located. A typical module 10 has a length, width and height of 14 inches, will have 10 plates 18 and will have 5 lights 26 and 5 receptors 32 for each plate. For such a module 10, the strips or PC boards will occupy a volume of between 15 and 16 cubic inches. Using commercially available products, the volume for the lights, receptors, multiplexers and other electronic components described in conjunction with FIGS. 4 and 5 can be limited no more than 2.0 and 3.3 cubic inches. Thus the boards and other electronic components needed for self-diagnosis of module 10 can, if desired, occupy a miniscule portion, less than 0.6 percent, of the module's total volume.

Optionally, a second set (not shown) of lights 26 and receptors 32 and associated circuitry elements similar to those described above can be provided for each plate 18 to achieve redundancy, The second set can be disposed orthogonal to the first set, along plate edges 64 and 66 shown in FIG. 3. Additionally, a memory chip 62 can be part of or be communicated with microprocessor 36. The chip's purpose is to monitor lights 26, receptors 32 and the associated circuitry to determine if these elements malfunction or deteriorate over time based on reference parameters derived from empirical testing and manufacturing specifications of these elements. A predetermined deviation from the reference parameters will indicate a fault in the self-diagnostic system of armor module 10.

Operation of Self-Diagnostic Means

Monitoring the light intensity experienced by receptors 32, the photo detectors, is the core of the self diagnosis in that cracks in transparent armor plates 18 reflect light back to the source, thereby reducing the amount of light transmitted to receptors 32.

Lights 26, receptors 32, CAN bus 34, microprocessor 36 lines 38*a*-38*h*, driver 40, voltage source 42 multiplexer 44, multiplexers 46*a*-46*h*, multiplexer 48 and converter 50 comprise a self-diagnostic means for module 10. Basically, the health of each individual plate 18 in armor module 10 is determined one at a time by measurements taken from one row of receptors along an edge 28 of the individual plate wherein microprocessor 36 gathers and processes the measurements for each row separately. Following is a more detailed description of a preferred method of operation for the self-diagnostic means.

For each row of receptors 32, measurements are taken receptor by receptor and this procedure is preferably repeated in a plurality of trials for each row, there typically being four trials for a row. From the measurements is determined the average light intensity for each receptor in the row and the highest value of the average intensities is stored. The absolute value of maximum deviation in average light intensity between adjacent receptors is found and is stored. A normalized maximum deviation is computed by dividing the highest value of the average intensities by the absolute value of the maximum deviation in light intensity between adjacent receptors. The value of the normalized maximum determines whether a plate 18 is definitely healthy, definitely damaged or further testing is needed.

Figure 6:
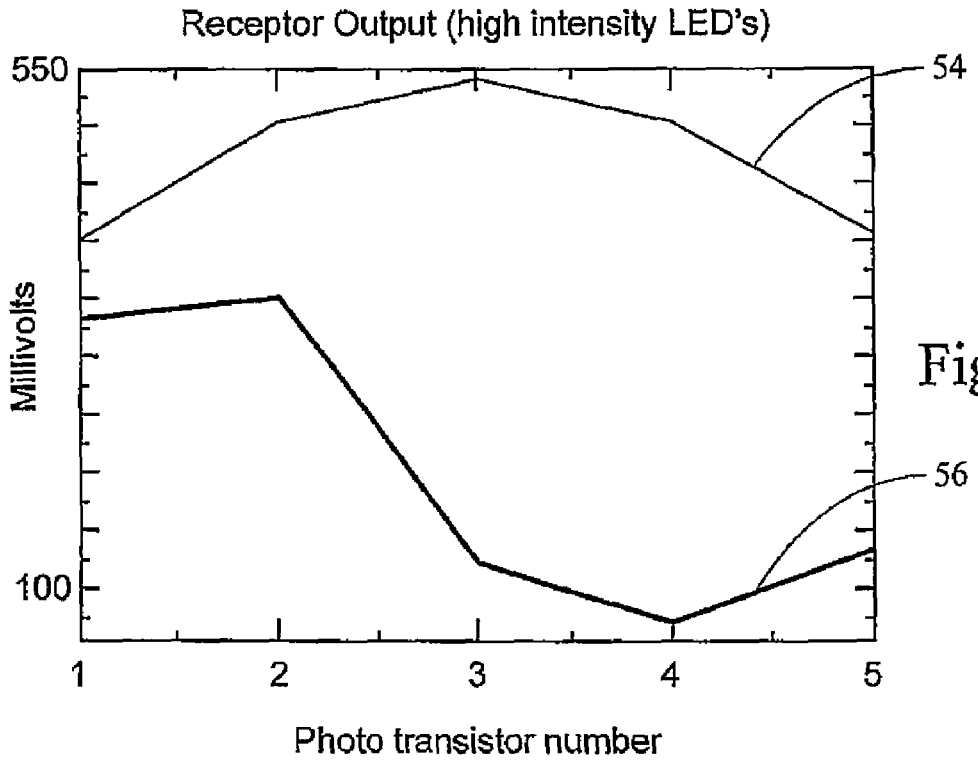
FIG. 6 is a graph of test data resulting from operation of the armor structure's self diagnostic system using relatively high powered LEDs.

An example of an application of the foregoing method is provided in conjunction with FIG. 6 where a set of five receptors 32 are subjected to light from a set of five relatively high intensity LEDs typically requiring between 1.0 and 1.5 watts for the set. On graph line 54 are readings in millivolts from a first tested plate representing the average light intensity experienced by receptors (or photo transistors) numbered 1 through 5. The readings on line 54 are 399, 505, 554, 499 and 409, and the normalized maximum deviation is 106/554 or 0.19. This value of the normalized maximum deviation indicates that the tested plate is healthy or undamaged. On line 56 are readings from a second plate tested in a similar fashion to the first. The readings are 332, 353, 128, 76 and 135, and the normalized maximum deviation 225/353 or 0.64. The normalized maximum deviation here represents an unhealthy or damaged plate.

Figure 7:
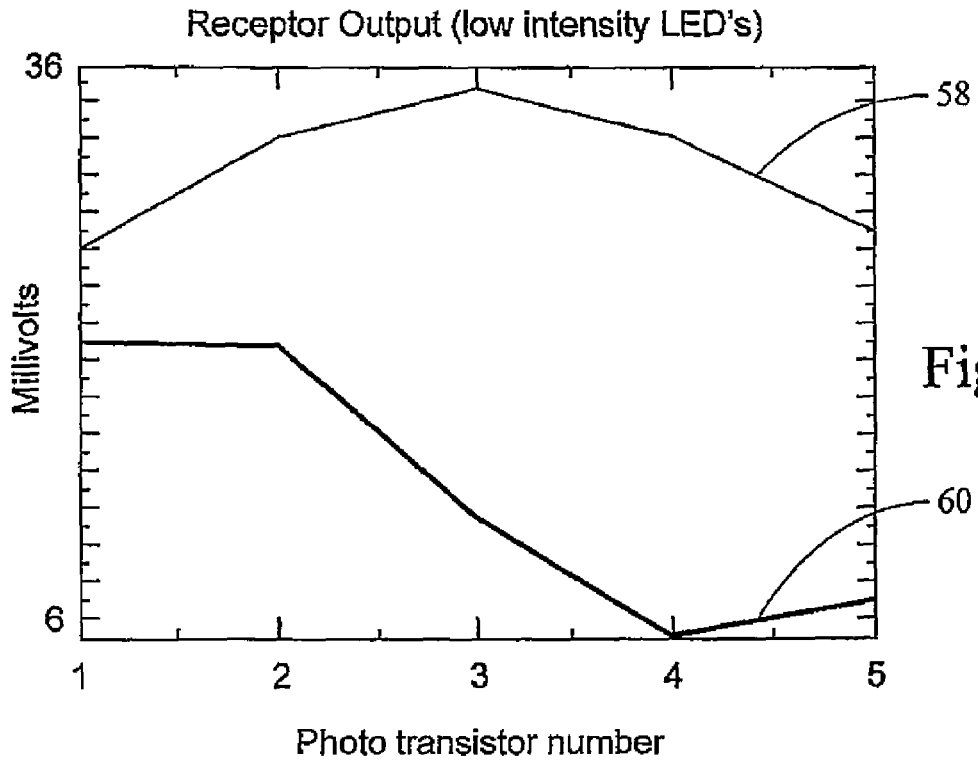
FIG. 7 is a graph of test data resulting from operation of the armor structure's self diagnostic system using relatively low powered LEDs.

Another example of an application of the foregoing method is provided in conjunction with FIG. 7 where a set of five receptors 32 are subjected to light from a set of five relatively low intensity LEDs typically requiring about 0.10 watts for the set. On graph line 58 are readings in millivolts from a third tested plate representing the average light intensity experienced by receptors (or photo transistors) numbered 1 through 5. The readings on line 58 are 26, 32, 35, 32 and 27, and the normalized maximum deviation is 6/35 or 0.17. This value of the normalized maximum deviation indicates that the tested plate is healthy or undamaged. On line 60 are readings from a fourth plate tested in a similar fashion to the third. The readings are, 21, 21, 12, 5 and 7, and the normalized maximum deviation 9/21 or 0.43. The normalized maximum deviation here represents an unhealthy or damaged plate. Experience thus far has shown that for maximum normalized deviations less than about 0.30, the plate is healthy, and for normalized maximum deviations greater than about 0.38, the plate is cracked or damaged. Currently, further testing or analysis of the plate is required when the normalized maximum deviation falls between 0.30 and 0.38.

Various alterations and modifications will become apparent to those skilled in the art without departing from the scope and spirit of this invention and it is understood this invention is limited only by the following claims.

What is claimed is:

1. A self-diagnostic armor module, comprising:

a box-like shell made from ballistic protection material, the shell enclosed so as to exclude external light from an interior of the armor module;

plates of transparent armor material within the shell oriented parallel to one another;

lights within the shell disposed adjacently along a first edge of each of said plates;

light responsive receptors disposed within the shell adjacently along a second, opposed edge of each of said plates;

circuitry connected to the lights and the receptors for controlling the lights and receptors such that the receptors produce signals indicating the health of the plates; and a transparent matrix of elastomeric, adhesive material completely encapsulating the plates, the light and the receptors, the matrix filling cavities within the shell, whereby the armor module is a voidless, solid structure.

2. The armor module of claim 1 wherein the matrix comprises:

planar zones along first interior surfaces of the shell separating the first interior surfaces from the plates, the first planar zones contacting and adhering to the first interior surfaces and the plates;

means for protecting the lights comprising a light protective portion of the matrix disposed between the lights and the first edges of the plates, the light protective zone contacting and adhering to the lights and the first edges;

the means for protecting the lights further comprising a light protective zone of the matrix disposed between the lights and second interior surfaces of the shell, the light protective zone contacting and adhering to the second interior surfaces and the plates; and means for protecting the receptors comprising a receptor protective portion of the matrix disposed between the receptors and the second edges of the plates, the receptor protective portion contacting and adhering to the receptors and the second edges;

the means for protecting the receptors further comprising a receptor protective zone of the matrix disposed between the receptors and third interior surfaces of the shell, the light protective zones contacting and adhering to the third interior surfaces and the plates.

3. The armor module of claim 2 wherein the lights are point sources of non collimated light.

4. The module of claim 1 wherein the circuitry comprises light strips on which the lights are mounted and receptor strips on which the receptors are mounted.

5. The armor module of claim 4 wherein the matrix comprises:

planar zones along first interior surfaces of the shell separating the first interior surfaces from the plates; and circuit protector means for protecting the light strips, the receptor strips, the lights and the receptor.

6. The armor module of claim 5 wherein the circuit protector means comprises:

a light strip protective portion of the matrix disposed between the light strips and the first edges of the plates;

a receptor protective portion of the matrix disposed between the receptor strips and the second edges of the plates;

a light strip protective zone of the matrix disposed between the light strips and second interior surfaces of the shell; and a receptor strip protective zone of the matrix disposed between the receptor strips and a third interior surface of the shell.

7. The armor of claim 6 wherein the matrix encapsulates and adheres to the light strips, the lights, the receptor strips and the receptors.

8. A unit of modular armor for a vehicle comprising:

an optically opaque outer shell of X-ray inhibitive material completely enclosed to exclude external visible light from an interior of the module;

means connected to the shell for mounting the module to the vehicle;

transparent armor plates of varied material and thickness within the shell, the plates disposed in parallel, closely spaced relation;

a first PC board comprised of light strips disposed along first edges of the plates;

rows of miniature incoherent point source lights on the light strips located adjacently along the first edges;

a second PC board comprised of receptor strips located along second edges of the plates opposed to the first edges;

rows of receptors on the receptor strips located along the second edges of the plates;

wherein each of the lights is in direct opposed relation to a corresponding one of the receptors;

logic means circuitry in the boards for illuminating the rows of the lights in a row-by-row sequence, and for allowing activation only of the receptors directly opposed to illuminated lights;

wherein the logic means circuitry comprises analysis means for determining the health of the plates in response to signals from the receptors;

a transparent resilient matrix within the shell in which each of the plates and the boards are suspended and encapsulated, wherein the matrix occupies all space not occupied by other elements within the shell.

9. The module of claim 8 wherein the matrix comprises thin, sheet-like layers disposed between adjacent plates and adhered to the adjacent plates.

10. The module of claim 9 wherein:

the shell is a box-like structure having flat, rectangular interior surfaces;

the matrix has generally planar zones disposed on each of the interior surfaces;

the boards are within an opposed pair of the planar zones; and remaining ones of the planar zones contain only matrix material.

11. The module of claim 10 wherein the boards, the lights and the receptors together occupy about 0.6 percent or less of the module's volume.

12. A self-diagnostic armor module, comprising:

a box-like shell made from ballistic protection material, the shell enclosed so as to exclude external light from an interior of the armor module;

plates of transparent armor material within the shell;

lights within the shell disposed adjacently along a first edge of each of said plates, the lights being non collimated incoherent point sources of light whose illumination sectors overlap;

light responsive receptors disposed within the shell adjacently along a second, opposed edge of each of said plates;

circuitry connected to the lights and the receptors for controlling the lights and receptors such that the receptors produce signals indicating the health of the plates;

analyses means within the circuitry responsive to the signals for producing a value of a normalized maximum for each plate which indicates a health condition of the plates; and resilient means for protecting the lights, the receptors and the circuitry means, the resilient means comprising a transparent matrix of elastomeric, adhesive material encapsulating the plates, the light and the receptors, the matrix filling cavities within the shell, whereby the armor module is a voidless, solid structure.

13. The module of claim 12 wherein the lights and receptors are in direct contact with respective edges of the plates.

14. The module of claim 13 wherein the matrix includes sheet-like layers between adjacent plates bonding the plates to one another.

15. The module of claim 12 wherein regions of the matrix between the plates and the shell are thicker than the shell.

* * * * *